US011299977B2

(12) United States Patent
Breaux et al.

(10) Patent No.: US 11,299,977 B2
(45) Date of Patent: Apr. 12, 2022

(54) RECESSED POCKETS FOR A DRILL COLLAR

(71) Applicant: HALLIBURTON ENERGY SERVICES, INC., Houston, TX (US)

(72) Inventors: Brian David Breaux, Houston, TX (US); Michael Dewayne Finke, Cypress, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/651,503

(22) PCT Filed: Sep. 4, 2019

(86) PCT No.: PCT/US2019/049525
§ 371 (c)(1),
(2) Date: Mar. 27, 2020

(87) PCT Pub. No.: WO2020/236199
PCT Pub. Date: Nov. 26, 2020

(65) Prior Publication Data

US 2021/0404323 A1 Dec. 30, 2021

Related U.S. Application Data

(60) Provisional application No. 62/850,429, filed on May 20, 2019.

(51) Int. Cl.
*E21B 47/017* (2012.01)
*E21B 47/013* (2012.01)

(52) U.S. Cl.
CPC ..... *E21B 47/017* (2020.05); *E21B 47/013* (2020.05)

(58) Field of Classification Search
CPC ..... E21B 47/017; E21B 47/013
See application file for complete search history.

(56) References Cited

U.S. PATENT DOCUMENTS 5,931,240 A * 8/1999 Cox ..... E21B 7/064 175/73
6,148,935 A * 11/2000 Wentworth ..... E21B 10/56 175/398

(Continued)

FOREIGN PATENT DOCUMENTS

CN 201851102 U 6/2011
WO 2005072354 A1 8/2005

OTHER PUBLICATIONS

English abstract of CN201851102; retrieved from www.espacenet.com on May 10, 2019.

(Continued)

*Primary Examiner* — Nicole Coy
(74) *Attorney, Agent, or Firm* — Polsinelli PC

(57) ABSTRACT

A drill collar having at least one pocket for receiving at least one component. The at least one pocket includes a rectangular portion that extends from a first end to a second end. The rectangular portion also includes a base surface. Each of the first and the second ends includes a transition surface extending from the base surface to a pair of shoulder surfaces and a channel. The pair of shoulder surfaces and a surface of the channel are parallel to the base surface. The channel extends to an end pocket that can be in communication with an aperture.

18 Claims, 7 Drawing Sheets

(56) References Cited

U.S. PATENT DOCUMENTS

| | | | | |
|---|---|---|---|---|
| 6,666,285 | B2 | 12/2003 | Jones et al. | |
| 6,927,390 | B2 | 8/2005 | Mikael | |
| 6,932,154 | B2 | 8/2005 | Zillinger | |
| 7,980,331 | B2 | 7/2011 | Hall et al. | |
| 8,939,237 | B2 * | 1/2015 | Runquist | E21B 47/01 175/398 |
| 9,187,998 | B2 | 11/2015 | Sherrill et al. | |
| 9,422,802 | B2 * | 8/2016 | Chau | E21B 17/003 |
| 9,435,193 | B2 | 9/2016 | Chau et al. | |
| 10,006,280 | B2 | 6/2018 | Logan et al. | |
| 10,227,840 | B2 * | 3/2019 | Nguyen | B29C 39/10 |
| 10,280,735 | B2 | 5/2019 | Finke et al. | |
| 2005/0205299 | A1 | 9/2005 | Michael et al. | |
| 2013/0277114 | A1 | 10/2013 | Hook et al. | |
| 2015/0300098 | A1 | 10/2015 | Logan et al. | |
| 2016/0333646 | A1 * | 11/2016 | Olin | E21B 47/135 |
| 2016/0348495 | A1 | 12/2016 | Chau et al. | |
| 2017/0306709 | A1 | 10/2017 | Cull et al. | |
| 2019/0271193 | A1 * | 9/2019 | Peters | E21B 7/062 |

OTHER PUBLICATIONS

International Search Report & Written Opinion; PCT Application No. PCT/US2019/049525; dated May 27, 2020.

* cited by examiner

RECESSED POCKETS FOR A DRILL COLLAR

CROSS-REFERENCE TO RELATED APPLICATIONS

This application is a national stage entry of PCT/US2019/049525 filed Sep. 4, 2019, which claims the benefit of U.S. provisional application 62/850,429 filed May 20, 2019, each of the said applications are expressly incorporated herein in its entirety.

FIELD

The present disclosure relates generally to drill collars used in a wellbore system. In at least one example, the present disclosure relates to a drill collar having recessed pocket(s) exposed at the collar's exterior and which is configured to receive a component or the like in the pocket and over which a protective pressure sleeve can be installed to protect the installed content within the pocket.

BACKGROUND

Wellbores are drilled into the earth for a variety of purposes including accessing hydrocarbon bearing formations. A variety of downhole tools can be used within a wellbore in connection with accessing and extracting such hydrocarbons. The downhole tools can measure, record, store, and/or pass along data related to drilling parameters to the surface (e.g., by telemetry or wired pipe) and can be subjected to high pressures and stress from the drilling process and downhole environment, including the imposition of significant bending moments on the tools. An exemplary component of such downhole tools are drill collars that are tubular components of the drill string that have relatively thick walls and desirably provide significant weight to the drill string. Because the walls are relatively thick, cutouts or recessed pockets can be made into them at the collar's exterior surface for housing components such as sensors. To protect the content of the pocket, such as installed delicate sensors, protective coverings, in the form of pressure tight sleeves can be installed over the pockets that prevent damaging wellbore fluids from reaching the components in the pockets during operation. These pockets, however, because they reduce the thickness of the collar's wall, can have the effect of compromising the collar's strength as a component of the drill string and ultimately result in failure during drilling. Therefore, the present disclosure appreciates the importance of the recesses or pockets being carefully designed to minimize weakening the collar, as well as avoid creating points of stress concentration, also referred to as stress risers or raisers, that can be caused at least in part when sharp angular physical features are included in and at the recess. The fortitude of the drill collar must also be maintained and sufficient to withstand the effects of any pre-loading stress that is imposed by the tight installation of the protective pressure sleeve over the recessed area of the drill collar.

BRIEF DESCRIPTION OF THE DRAWINGS

Implementations of the present technology will now be described, by way of example only, with reference to the attached figures, wherein.

DETAILED DESCRIPTION

Figure 1A:
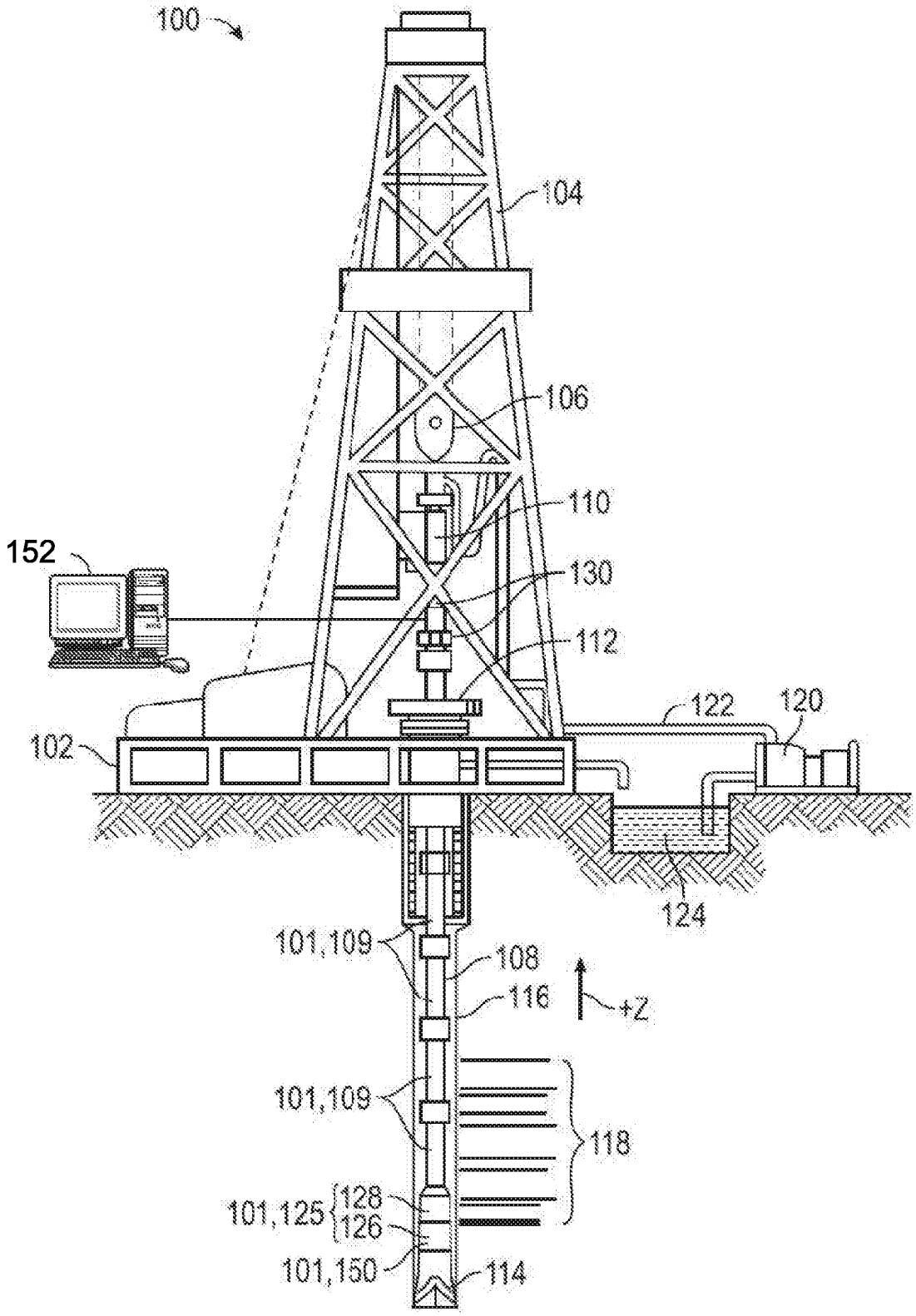
FIG. 1A is a diagram illustrating an example of an environment in which a drilling system can be used in accordance with the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts can be exaggerated to better illustrate details and features of the present disclosure.

Disclosed herein is a drill collar with recesses or pockets formed therein. The drill collar can have a protective pressure sleeve installed thereover for operation in a wellbore environment and a system can include any or all of the following features. A drill collar of a pressure sleeve system includes at least one pocket, or a plurality of pockets (multiple pockets), though it will be appreciated that the drill collar can be used without a pressure sleeve system and/or as a standalone component. If a plurality of pockets is provided, the pockets are typically equidistantly spaced about the circumference of the drill collar. In the illustrative example of FIG. 2, four pockets are equidistantly spaced about the circumference of the drill collar. However, for simplicity in this disclosure, one pocket is typically described, but it should be understood that each of a plurality of pockets, or the "at least one pocket" is being exemplarily described.

According to the present disclosure, the pocket can be optimized to reduce and/or prevent stress concentrations and/or stress risers from forming. The pocket can include a rectangular portion extending from a first end to a second end of the pocket. The rectangular portion can have a base surface and opposing side surfaces. The opposing side surfaces can be perpendicular to the base surface and parallel to each other. The opposing side surfaces can extend to a rounded end at each of the first end and the second end. Each of the first end and the second end can have a transition surface extending from the base surface to a pair of shoulder surfaces and a channel. The channel can extend between a pair of protrusions. The pair of shoulder surfaces and a surface of the channel can be parallel to the base surface. The channel can extend to an end pocket. The end pocket can be in communication with an aperture.

Referring to FIG. 1A, a diagrammatic view illustrates an exemplary wellbore drilling environment 100, for example a logging while drilling (LWD) and/or measurement while drilling (MWD) wellbore environment, in which the present disclosure can be implemented. As illustrated in FIG. 1A, a drilling platform 102 is equipped with a derrick 104 that supports a hoist 106 for raising and lowering one or more drilling components 101 which can include, for example, a drill string 108 which can include one or more drill collars 109, a drill bit 114, and/or a bottom-hole assembly 125. The drilling components 101 are operable to drill a wellbore 116. The drilling components 101 also can include housings for one or more downhole tools. The drilling components 101 can be manufactured from one or more materials including, but not limited to, steel, stainless steel, an alloy, or the like. The material can also be magnetic or non-magnetic.

The hoist 106 suspends a top drive 110 suitable for rotating the drill string 108 and lowering the drill string 108 through a well head 112. Connected to the lower end of the drill string 108 is a drill bit 114. As the drill bit 114 rotates, the drill bit 114 creates a wellbore 116 that passes through various formations 118. A pump 120 circulates drilling fluid through a supply pipe 122 to the top drive 110, down through the interior of the drill string 108, through orifices in the drill bit 114, back to the surface via the annulus around the drill string 108, and into a retention pit 124. The drilling fluid transports cuttings from the wellbore 116 into the pit 124 and aids in maintaining the integrity of the wellbore 116. Various materials can be used for drilling fluid, including oil-based fluids and water-based fluids.

As illustrated in FIG. 1A, sensors 126 can be provided, for example integrated into the bottom-hole assembly 125 near the drill bit 114. The sensors 126, in another example, can be integrated into a drill collar 202 of a pressure sleeve system 200. The sensors 126 can be mounted or received by at least one pocket 204 on the drill collar 202, as discussed relatively to FIGS. 2-6B.

As the drill bit 114 extends the wellbore 116 through the formations 118, the sensors 126 can collect measurements of various drilling parameters, for example relating to various formation properties, the orientation of the drilling component(s) 101, dog leg severity, pressure, temperature, weight on bit, torque on bit, and/or rotations per minute. The sensors 126 can be any suitable sensor to measure the drilling parameters, for example transducers, fiber optic sensors, and/or surface and/or downhole sensors. The bottom-hole assembly 125 can also include a telemetry sub 128 to transfer measurement data to a surface receiver 130 and to receive commands from the surface. In some examples, the telemetry sub 128 communicates with a surface receiver 130 using mud pulse telemetry. In other examples, the telemetry sub 128 does not communicate with the surface, but rather stores logging data for later retrieval at the surface when the logging assembly is recovered. Notably, one or more of the bottom-hole assembly 125, the sensors 126, and the telemetry sub 128 can also operate using a non-conductive cable (e.g. slickline, etc.) with a local power supply, such as batteries and the like. When employing non-conductive cable, communication can be supported using, for example, wireless protocols (e.g. EM, acoustic, etc.) and/or measurements and logging data can be stored in local memory for subsequent retrieval at the surface.

Each of the sensors 126 can include a plurality of tool components, spaced apart from each other, and communicatively coupled together with one or more wires. The telemetry sub 128 can include wireless telemetry or logging capabilities, or both, such as to transmit information in real time indicative of actual downhole drilling parameters to operators on the surface.

The sensors 126, for example an acoustic logging tool, can also include one or more computing devices 150 communicatively coupled with one or more of the plurality of drilling components 101. The computing device 150 can be configured to control or monitor the performance of the sensors 126, process logging data, and/or carry out the methods of the present disclosure.

In some examples, one or more of the sensors 126 can communicate with the surface receiver 130, such as a wired drillpipe. In other cases, the one or more of the sensors 126 can communicate with the surface receiver 130 by wireless signal transmission. In at least some cases, one or more of the sensors 126 can receive electrical power from a wire that extends to the surface, including wires extending through a wired drillpipe. In at least some examples the methods and techniques of the present disclosure can be performed by a controller 152, for example a computing device, on the surface. In some examples, the controller 152 can be included in and/or communicatively coupled with surface receiver 130. For example, the surface receiver 130 of wellbore operating environment 100 at the surface can include one or more of wireless telemetry, processor circuitry, or memory facilities, such as to support substantially real-time processing of data received from one or more of the sensors 126. In some examples, data can be processed at some time subsequent to its collection, wherein the data can be stored on the surface at surface receiver 130, stored downhole in telemetry sub 128, or both, until it is retrieved for processing.

Figure 1B:
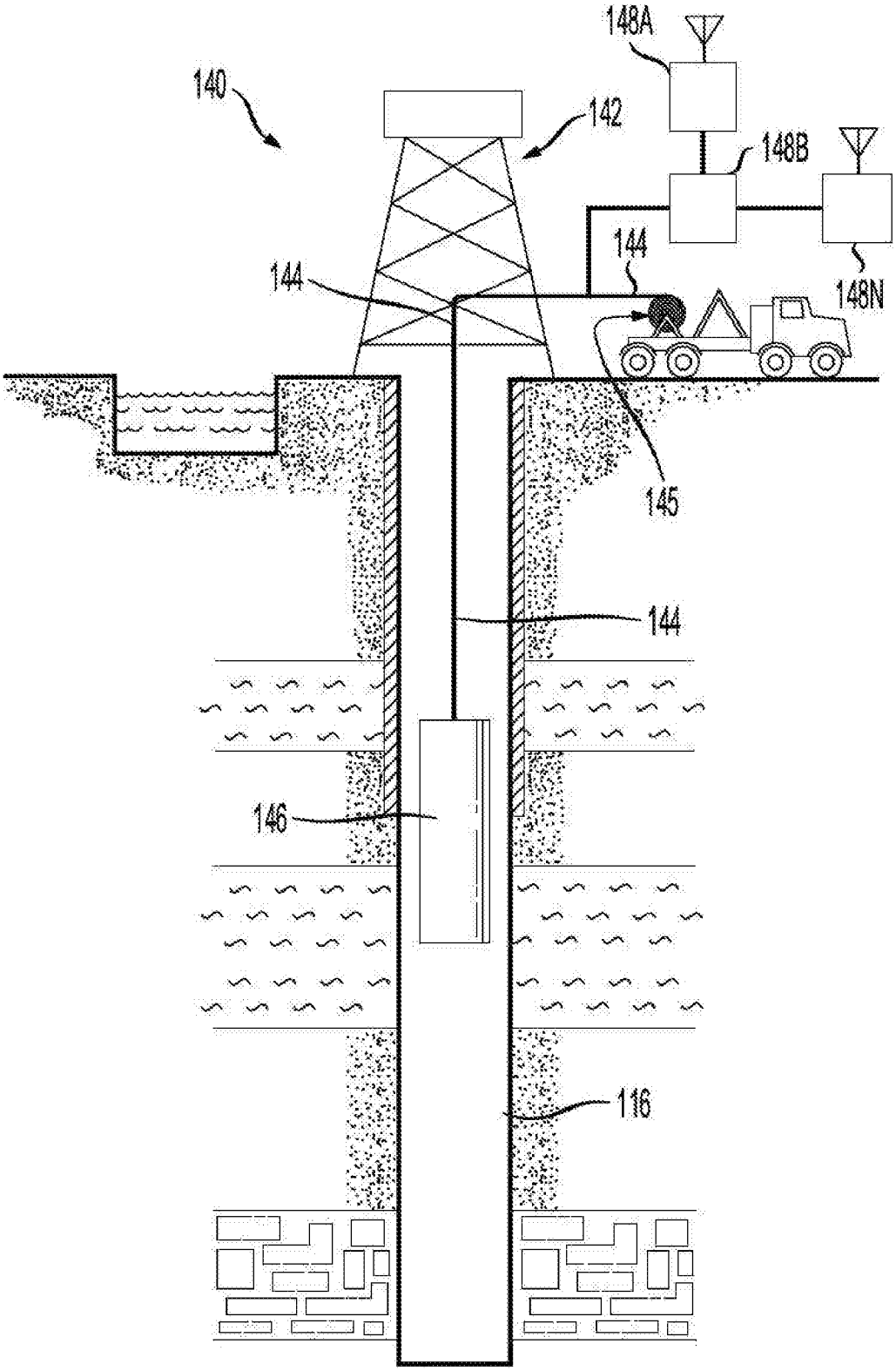
FIG. 1B is a diagram illustrating an example downhole environment having tubulars, in accordance with some examples.

Referring to FIG. 1B, an example system 140 for downhole line detection in a downhole environment having tubulars can employ a tool having a tool body 146 in order to carry out logging and/or other operations. For example, instead of using the drill string 108 of FIG. 1A to lower tool body 146, which can contain sensors or other instrumentation for detecting and logging nearby characteristics and conditions of the wellbore 116 and surrounding formation, a wireline conveyance 144 can be used. The tool body 146 can include a resistivity logging tool. The tool body 146 can be lowered into the wellbore 116 by wireline conveyance 144. The wireline conveyance 144 can be anchored in a drill rig 145 or a portable means such as a truck. The wireline conveyance 144 can include one or more wires, slicklines, cables, and/or the like, as well as tubular conveyances such as coiled tubing, joint tubing, or other tubulars.

The illustrated wireline conveyance 144 provides support for the tool, as well as enabling communication between tool processors 148A-N on the surface and providing a power supply. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more processors 148A-N, which can include local and/or remote processors. Moreover, power can be supplied via the wireline conveyance 144 to meet power requirements of the tool. For slickline or coiled tubing configurations, power can be supplied downhole with a battery or via a downhole generator.

Figure 2:
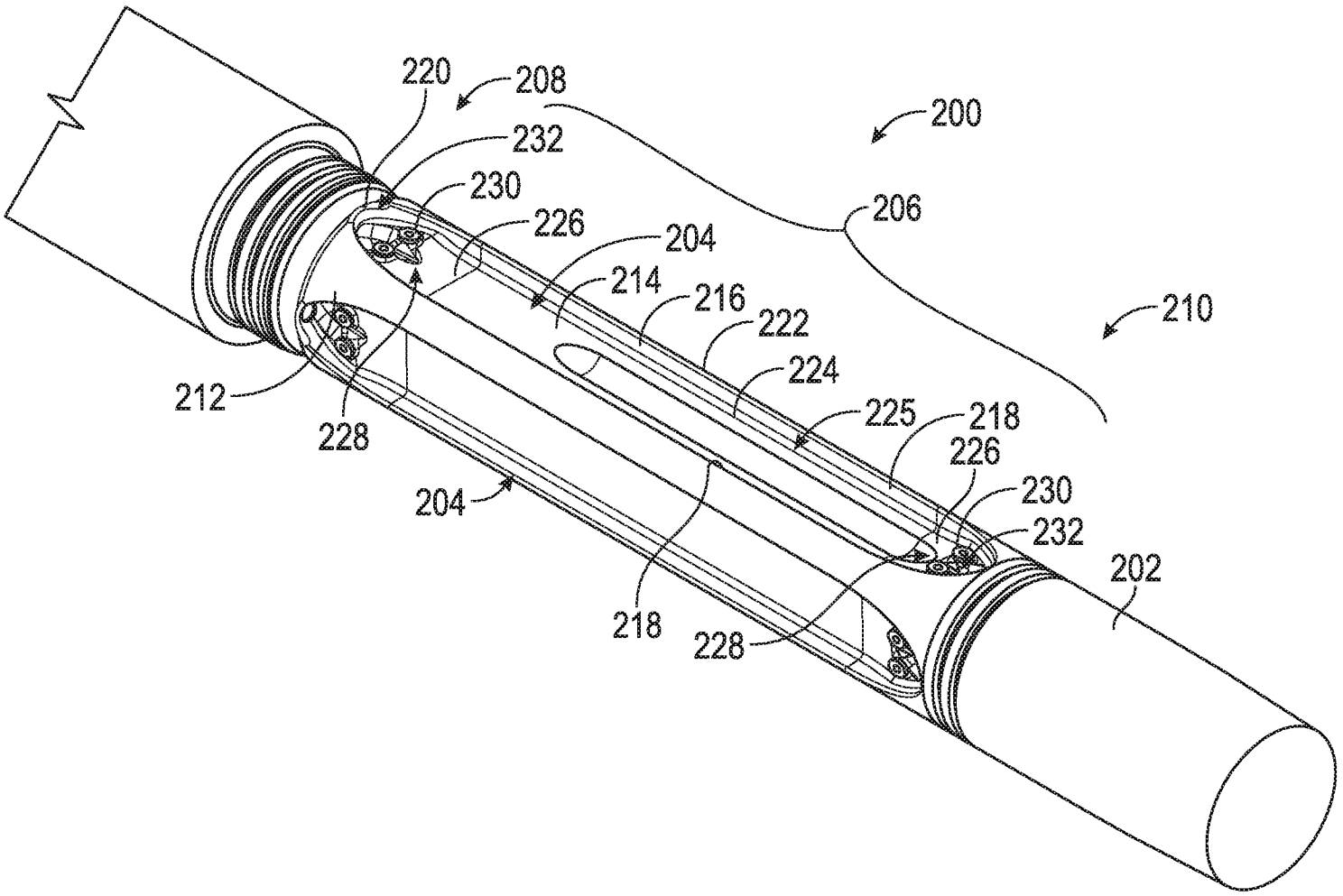
FIG. 2 is a diagram of an example drill collar which can be employed with the drilling system shown in FIG. 1A or the tubulars of FIG. 1B.
Figure 3:
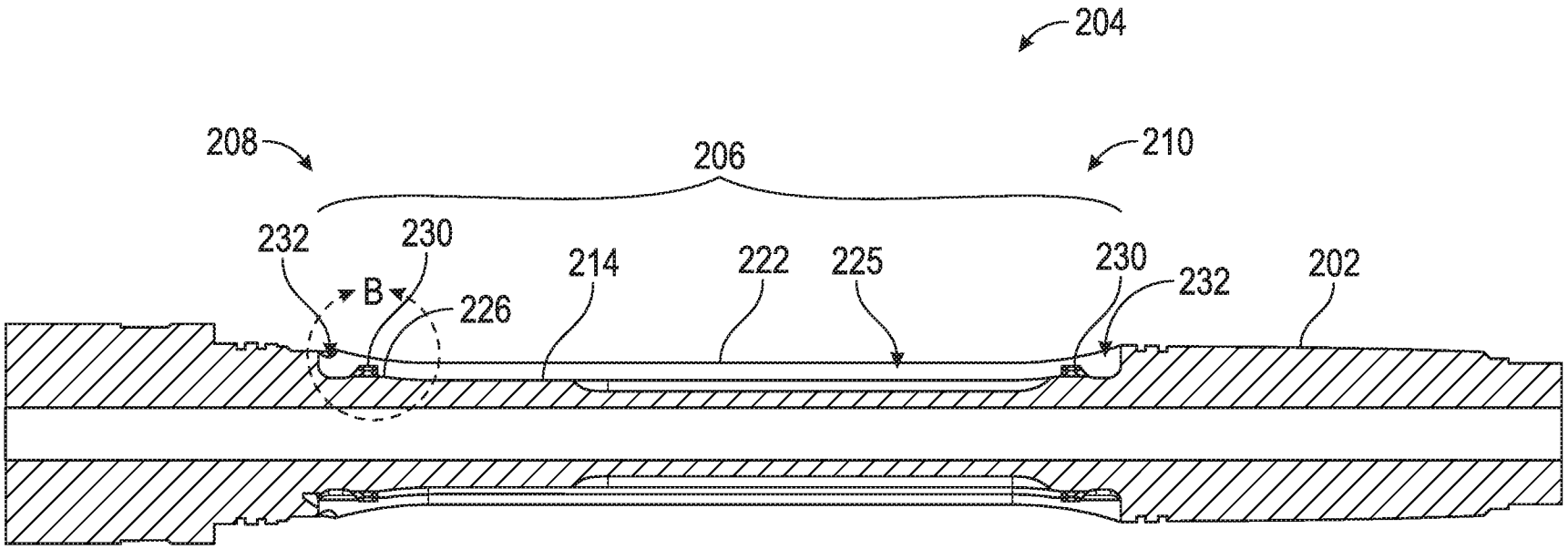
FIG. 3 is a cross-section of the drill collar shown in FIG. 2.

FIGS. 2-3 are a diagram and a cross-section, respectively, of the drill collar 202 of the pressure sleeve system 200 having at least one pocket 204 formed on the drill collar 202. It will be appreciated that the drill collar 202 can be used in other applications without the pressure sleeve system 200, can be used with other components, or can be used as a standalone component. The pressure sleeve system 200 can be positioned anywhere on the drill string 108 such as, but not limited to, above the drill bit 114, above the bottom-hole assembly 125, and/or above one or more drill collars 109. The pressure sleeve system 200 can house component(s) (not shown) in one or more of the pockets 204 and under a pressure sleeve (not shown). For example, the components can include electronic equipment, sensors, transmitters, receivers, batteries, power supplies, computing devices or components (e.g., processors, memory, etc.), sub-assemblies, sub-systems, or the like. The enclosed pocket 204 can prevent the components from being exposed to drilling fluids, which can be corrosive or otherwise detrimental to the components. The pocket 204 is advantageously wider than conventional pockets and capable of accommodating wide components or more than one component while also minimizing stress concentrations and/or stress risers. It will be appreciated that the pocket 204 can be formed on other components where a body that the pocket 204 is formed into can experience increased stresses from machining the pocket 204 into the body.

The pocket 204 includes a rectangular portion 206 extending between a first end 208 and a second end 210. In some examples, the first end 208 and the second end 210 can have identical measurements or dimensions, though in other examples, the first end 208 and the second end 210 can have varying measurements or dimensions. In the illustrated example, the pocket 204 is offset, or recessed, from an outer surface 212 towards a centerline of the drill collar 202. The rectangular portion 206 includes a base surface 214 and a side surface 216 extending between the base surface 214 and the outer surface 212. As shown, the base surface 214 is planar, though in other examples the base surface 214 can be non-planar, rounded, curved, undulating, wavy, and/or the like. In the illustrated example, the side surface 216 is perpendicular to the base surface 214, though the side surface can be angled relative to the base surface in other examples. The side surface includes opposing side surfaces 218 that are parallel to each other, though in other examples the opposing side surfaces 218 can be angled towards or away from each other. The opposing side surfaces 218 extend to each of the first end 208 and the second end 210 and taper towards each other in an elliptical shape to a curved end surface 220. The elliptical shape at each of the first end 208 and the second end 210 can alleviate stress concentrations and/or stress risers that can occur from joining two opposing sides and/or two offset surfaces.

The side surface 216 defines a pocket edge 222 at the outer surface 212 and a base edge 224 at the base surface 214. The pocket edge 222 and the base edge 224 each follow the shape of the side surface 216. Each of the pocket edge 222 and the base edge 224 can include a fillet, though each edge 222, 224 can not include a fillet in other examples. The pocket edge 222 fillet can facilitate installment of a component or tool. The pocket edge 222 can extend upward from the base surface 214 and include a break and a downward curve at each of the first end 208 and the second end 210, also visible in FIG. 4A for example. In any embodiment, the pocket 204 can include an inner pocket 225 disposed in the rectangular portion 206 and extending into the second end 210, as will be described in more detail relatively to FIGS. 6A-6B.

The pocket 204 further includes a transition surface 226 that extends from the base surface 214 to a channel 228 at each of the first end 208 and the second end 210. The channel 228 is disposed between a pair of protrusions 230 and ends at an end pocket 232, shown in more detail in FIGS. 4A-4B. A width of the channel 228 can be defined by the distance between each of the pair of protrusions 230 and/or by a shape of each of the pair of protrusions 230. In other examples, the channel 228 can be formed into the base surface 214 without a pair of protrusions.

Figure 4A:
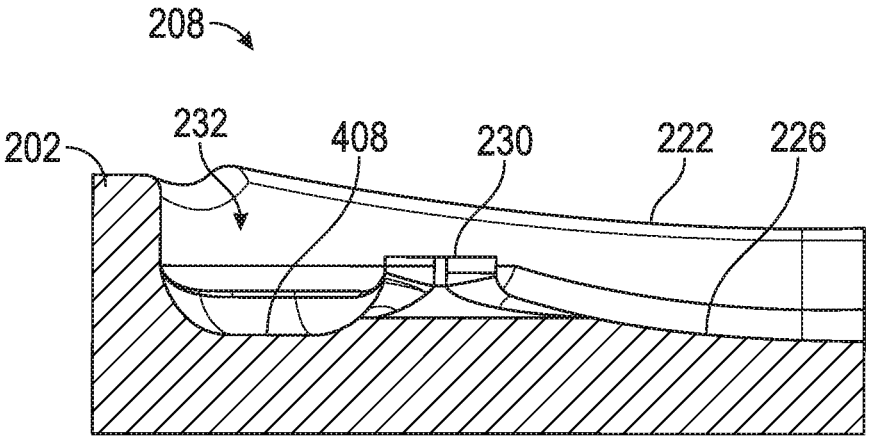
FIG. 4A is a diagram illustrating a cross-section of a first end of the drill collar shown in FIG. 2.
Figure 4B:
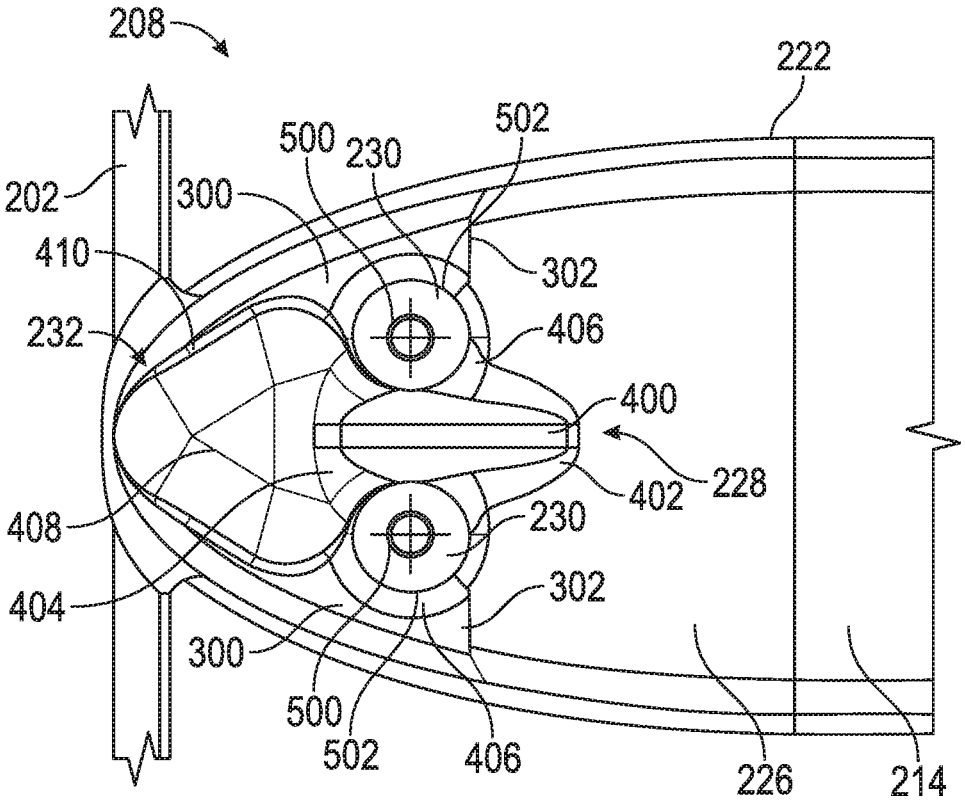
FIG. 4B is a diagram illustrating a detailed top view of the first end of the drill collar shown in FIG. 2.

FIGS. 4A-4B are each a diagram illustrating a cross section and a top detailed view, respectively, of the first end 208 of the drill collar 202 shown in FIG. 2. The transition surface 226 slopes upward from the base surface 214 to the channel 228, the pair of protrusions 230, and a pair of shoulder surfaces 300. The transition surface 226 further tapers towards the respective first end 208 and the second end 210 when viewed from above and is elliptical in shape. The transition surface 226 alleviates stress concentrations and/or stress risers that can occur from joining offset surfaces and from narrowing of the pocket 204 at the first end 208 and the second end 210.

Each of the channel 228, the pair of protrusions 230, and the pair of shoulder surfaces 300 are offset from the outer surface 212 at various depths that are less than a depth of the base surface 214. In the illustrated example, a depth of the channel 228 is greater than a depth of the pair of shoulder surfaces 300, which is less than a depth of the pair of protrusions 230. In other examples the depth of the channel 228 can be less than, greater than, or equal to the depth of the shoulder surfaces 300 and/or the depth of the pair of protrusions 230; the depth of the pair of shoulder surfaces 300 can be less than, greater than, or equal to the depth of the channel 228 and/or the depth of the pair of protrusions 230; and the depth of the pair of protrusions 230 can be less than, greater than, or equal to the depth of the channel 228 and/or the depth of the pair of shoulder surfaces 300.

The channel 228 includes a channel surface 400 extending between each of the pair of protrusions 230 and between a first fillet 402 and a second fillet 404. The first fillet 402 is positioned between the transition surface 226 and the channel surface 400 and the second fillet 404 is positioned between the end pocket 232 and the channel surface 400. Each of the first fillet 402 and the second fillet 404 are varying in thickness and radius to provide a smooth transition between the transition surface 226, the end pocket 232, each of the pair of protrusions 230 and the channel surface 400, thereby reducing and/or preventing stress concentrations and/or stress risers from forming. Each of the first fillet 402 and the second fillet 404 can extend into a fillet 406 of each of the pair of protrusions 230. As shown, the channel surface 400 is planar and parallel to the base surface 214 at a center line of the channel surface 400 and curves upwards to each of the pair of protrusions 230. The channel 228 can receive wiring from a component such as sensor, for example.

As shown, each of the pair of shoulder surfaces 300 is planar and parallel to the base surface 214. In other examples, each of the pair of shoulder surfaces 300 can be angled, rounded, curved, undulating, wavy, and/or the like. Each of the shoulder surfaces 300 includes a transition edge 302 between the transition surface 226 and each of the shoulder surfaces 300. As shown, each transition edge 302 is a corner, though each transition edge 302 can be a fillet or rounded edge in other examples. Each of the pair of shoulder surfaces 300 can receive wiring from a component such as a sensor, for example, and can be further bound by the side surface 216 and each of the pair of protrusions 230. In other examples, each of the pair of shoulder surfaces 300 are not bound each of the pair of protrusions 230.

Each of the pair of protrusions 230 are cylindrical in shape, though in other examples can be other shapes such as a square, rectangle, oval, star, triangle, or the like. In other examples, each of the pair of protrusions 230 can be obround-shaped (i.e., pill-shaped). Such obround-shaped pair of protrusions 230 can define the channel 228 by a pair of parallel surface. Such pair of parallel surfaces can be spaced wider apart than the cylindrical shaped pair of protrusions 230. Each of the pair of protrusions 230 can include an aperture 500 having a threaded surface for receiving a threaded fastener. In some examples, each of the pair of protrusions 230 can be solid. In other examples, each aperture 500 can have a smooth bore. Each of the pair of protrusions 230 includes the fillet 406 that is intersected by the first fillet 402, the second fillet 404, the transition edge 302, and the channel surface 400. In other examples, the fillet 406 can bisect the first fillet 402, the second fillet 404, the transition edge 302, and/or the channel surface 400. As shown, each of the pair of protrusions 230 includes an upper edge 502. In the illustrated example, the upper edge 502 is a sharp corner, though in other examples, the upper edge 502 can be radiused.

Turning to the end pocket 232, the end pocket 232 is shaped as a triangle with rounded corners when viewed from above. Each of the rounded corners can have a radius. In other examples, the end pocket 232 can be any shape such as, but not limited to, a square, circle, rectangle, star, oval, hexagon, or the like. In the illustrated example, the end pocket 232 includes an end pocket surface 408 that is planar and parallel to the base surface 214 towards a center of the end pocket 232 and curves up to an end pocket edge 410, and the second fillet 404. In some examples, the pocket 204 includes opening 234 shown in FIG. 5. The end pocket surface 408 can include a planar surface near the end pocket edge 410 that is also perpendicular to the base surface 214 in some examples. The end pocket edge 410 is a rounded edge having a radius in the illustrated example.

Figure 5:
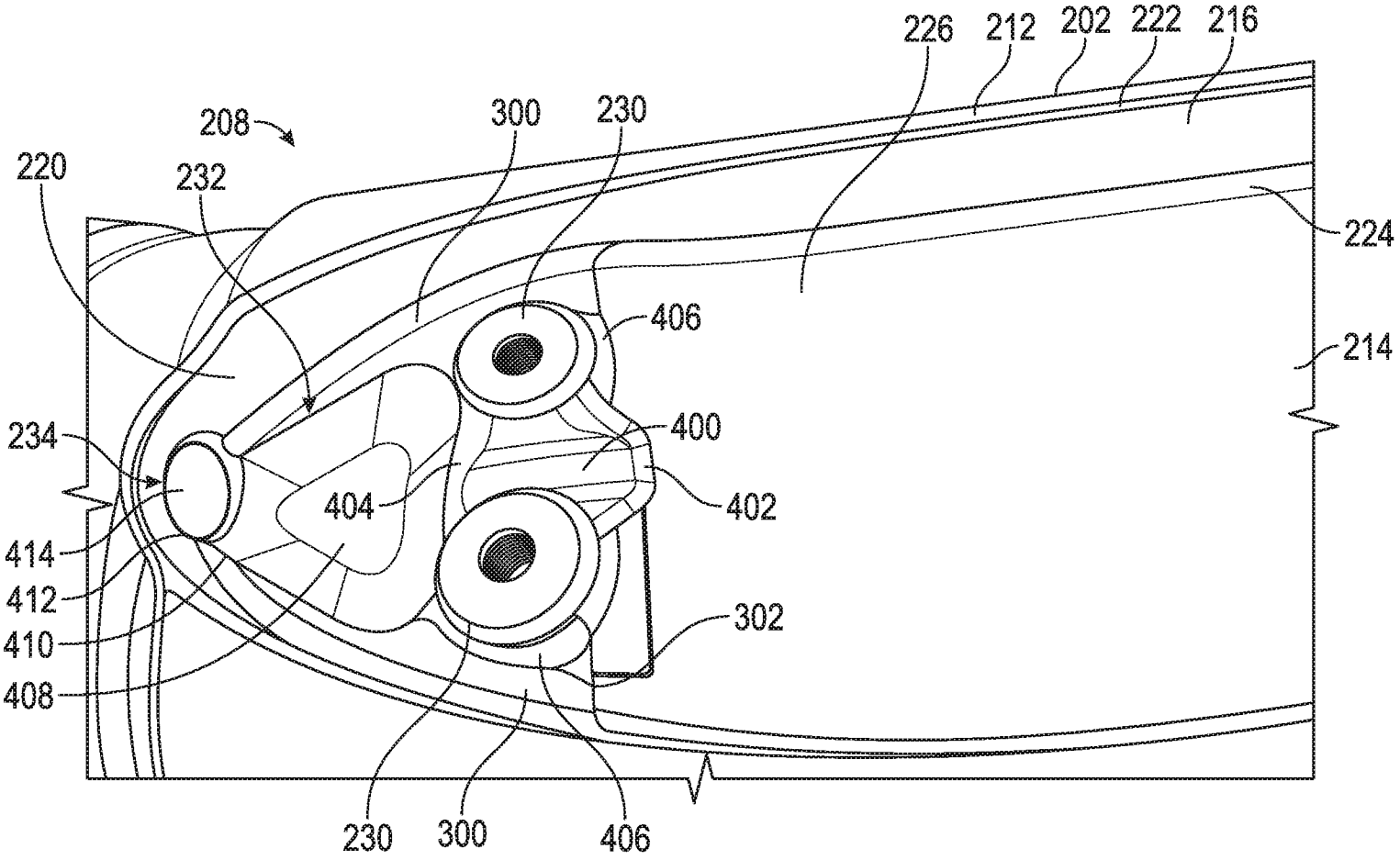
FIG. 5 is a diagram illustrated a top, isometric view of the first end of the drill collar shown in FIG. 2 having an opening.

Turning to FIG. 5, a top isometric view of the end pocket 232 is shown having an opening 234. In any example, the end pocket 232 of the first end 208 and/or the second end 210 can have an opening 234. In other examples, the end pocket 232 of the first end 208 and/or the second end 210 can have an opening 234 can not have an opening 234. The opening 234 extends into the drill collar 202 and is operable to receive wiring or the like. An edge 412 of the opening 234 between the end pocket surface 408 and a bore 414 of the opening 234 can be a fillet edge.

It will be appreciated that ranges described in the following example are but one set of ranges for the specific given example. Such ranges can vary or change in any embodiment included in this disclosure and can be a function of a width and/or depth of an object (e.g. sensor(s), circuit board(s), or the like) being mounted into the pocket 204, the number of objects being mounted in the pocket 204, a size of the pressure sleeve system 200, a desired operating dogleg, and material properties of the pressure sleeve system 200. In one specific example, the end pocket 232 has three rounded corners that can have a radius of substantially between R 0.2 to R 0.5. In the same example, one of the rounded corners can be wider than each of the two other rounded corners. Also in the same example, a distance between a centerline of each of the pair of protrusions 230 can be substantially between 0.4 to 1.0 inches and a distance between each of the centerline of the pair of protrusions 230 and the curved end surface 220 can be substantially between 0.2 to 0.7 inches. In the same example, a width of the channel 228 can be substantially between 0.2 to 0.7 inches.

Figure 6A:
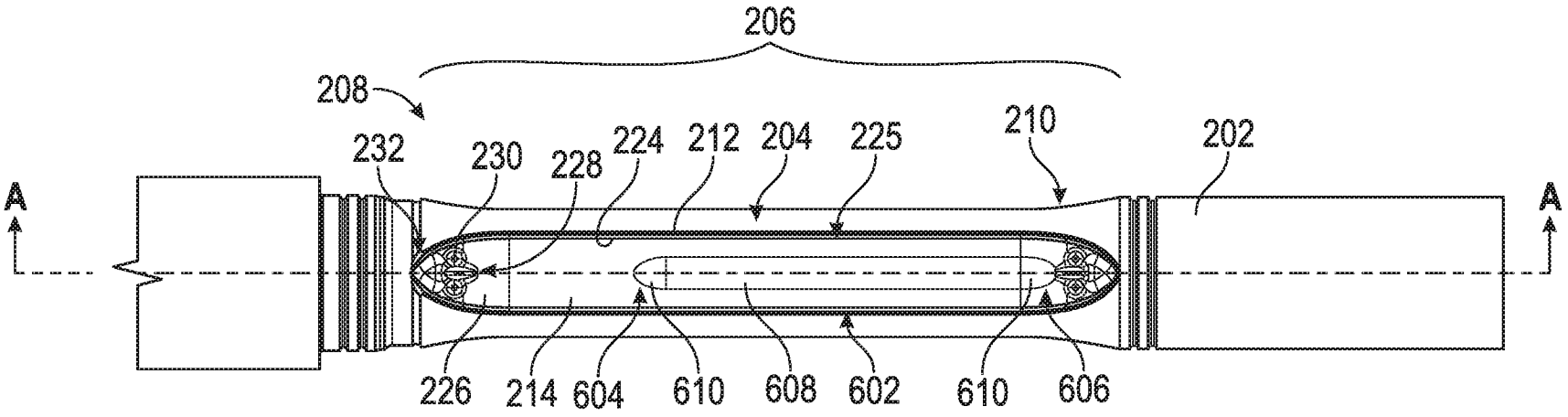
FIGS. 6A-6B are a diagram illustrating a top view and a side view, respectively, of the drill collar shown in FIG. 2.
Figure 6B:
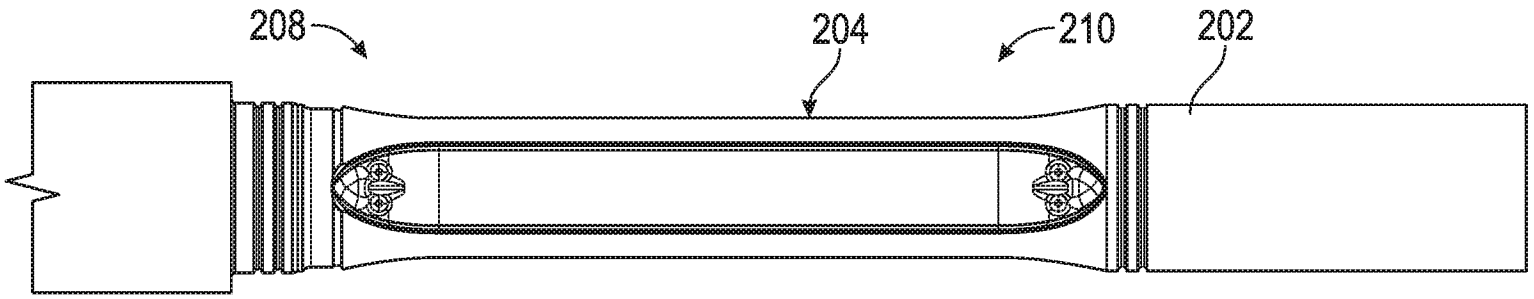

FIGS. 6A-6B are a diagram illustrating a top view and a side view, respectively, of the drill collar 202 shown in FIG. 2. In any embodiment, the pocket 204 can include the inner pocket 225 disposed in the rectangular portion 206 and extending into the second end 210. The inner pocket 225 includes an inner pocket edge 600 that can have a sharp corner as shown, though the inner pocket edge 600 can include a fillet in other examples. The inner pocket 225 extends into the base surface 214 and includes an inner pocket rectangular portion 602 extending from a first inner pocket end 604 to a second inner pocket end 606. Each of the first inner pocket end 604 and the second inner pocket end 606 are elliptical in shape. The inner pocket includes an inner pocket surface 608 that is cylindrical in shape, though the inner pocket surface can be planar, curved, sloped, ribbed, or the like in other examples. The inner pocket surface 608 extends to an inner end pocket surface 610 at each of the first inner pocket end 604 and the second inner pocket end 606. The inner end pocket surface 610 at the second inner pocket end 606 intersects the transition surface 226 and terminates at the channel 228. The inner end pocket surface 610 is elliptical in shape and combined with the elliptical shape of each of the respective first inner pocket end 604 and the second inner pocket end 606 alleviate stress concentrations and/or stress risers that can arise between the inner pocket surface 608 and the base surface 214, the transition surface 226, and the channel 228. The inner pocket 225 is operable to receive a portion of a component so that the pocket 204 can accommodate a larger component, such as, in one example, a gamma module. In other embodiments, the pocket 204 does not include an inner pocket and as such, the first end 208 and the second end 210 of the pocket 204 can be identical mirror images of each other, as visible in FIGS. 2 and 6B.

The pocket 204 shape and geometry as described and shown advantageously reduces a maximum stress of the drill collar 202 as compared to a conventional rectangular pocket having sharp edges and features. In one specific example simulation, the conventional pocket exceeded an allowable stress of the drill collar 202 material by 15%, thereby rendering the drill collar 202 as unsuitable for use in a wellbore 116 during drilling. In the same example simulation, the pocket 204 can reduce the maximum stress of the drill collar 202 by about 35%. As such, in the same simulation, the pocket 204 enabled an increase of a load capacity of the drill collar 202 by about 50% from a load capacity of the drill collar 202 with the conventional pocket. Thus, the pocket 204 advantageously maintains integrity of the drill collar 202 so as to not inhibit normal drilling operations while allowing for recessed pockets to be machined into the drill collar 202. It will be appreciated that the given percentages are specific to this example and that the percentages can vary or change for any embodiment of the simulation and/or pocket 204 disclosed herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it can be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter can have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Numerous examples are provided herein to enhance understanding of the present disclosure. A specific set of statements are provided as follows.

Statement 1: A pressure sleeve system comprising a drill collar having at least one pocket for receiving at least one component, the at least one pocket comprising a rectangular portion extending from a first end to a second end, the rectangular portion having a base surface, and each of the first and the second end having a transition surface extending from the base surface to a pair of shoulder surfaces, a pair of protrusions, and a channel, the pair of shoulder surfaces and a surface of the channel being parallel to the base surface, the channel extending to an end pocket in communication with an aperture; and a pressure sleeve operable to receive the drill collar.

Statement 2: A pressure sleeve system is disclosed according to Statement 1, wherein the end pocket is shaped as a rounded triangle.

Statement 3: A pressure sleeve system is disclosed according to Statements 1 or 2, wherein the end pocket includes an end pocket surface that is planar and parallel to the base surface at a center of the rounded triangle and curves upwards to an end pocket edge.

Statement 4: A pressure sleeve system is disclosed according to any of preceding Statements 1-3, wherein the end pocket edge is rounded.

Statement 5: A pressure sleeve system is disclosed according to any of preceding Statements 1-4, wherein the channel includes a first fillet between the channel and the transition surface and a second fillet between the channel and the end pocket, the first fillet and the second fillet each having a variable thickness and radius.

Statement 6: A pressure sleeve system is disclosed according to any of preceding Statements 1-5, wherein the channel surface curves upwards to each of the pair of protrusions.

Statement 7: A pressure sleeve system is disclosed according to any of preceding Statements 1-6, wherein an edge of the at least one pocket is elliptical at each of the first end and the second end.

Statement 8: A pressure sleeve system is disclosed according to any of preceding Statements 1-7, wherein the at least one pocket includes four pockets.

Statement 9: A pressure sleeve system is disclosed according to any of preceding Statements 1-8, wherein the at least one pocket further comprises an inner pocket disposed in the rectangular portion and the second end, the inner pocket operable to seat a portion of the at least one sensor.

Statement 10: A pressure sleeve system is disclosed according to any of preceding Statements 1-9, wherein the inner pocket includes an inner pocket rectangular portion extending from a first inner pocket end to a second inner pocket end.

Statement 11: A pressure sleeve system is disclosed according to any of preceding Statements 1-10, wherein an inner pocket surface of the rectangular portion is cylindrical.

Statement 12: A pressure sleeve system is disclosed according to any of preceding Statements 1-11, wherein each of the first inner pocket end and the second inner pocket end include an inner pocket end surface, and wherein the inner pocket end surface is elliptical.

Statement 13: A pressure sleeve system is disclosed according to any of preceding Statements 1-12, wherein the second inner pocket end extends through the transition surface and to the channel of the second end.

Statement 14: A pressure sleeve system is disclosed according to any of preceding Statements 1-13, wherein the at least one component can include at least one of one or more electronic equipment, at least one sensor, at least one transmitter, at least one receiver, at least one battery, at least one power supply, at least one computing device, at least one computing device component, a sub-assemblies, and a subsystems.

Statement 15: A pressure sleeve system comprising: a drill collar having at least one pocket for receiving at least one component, the at least one pocket comprising: a rectangular portion extending from a first end to a second end, the rectangular portion having a base surface, and each of the first and the second end having a transition surface extending from the base surface to a pair of shoulder surfaces, a pair of protrusions, and a channel, the pair of shoulder surfaces and a surface of the channel being parallel to the base surface, the channel extending to an end pocket in communication with an aperture, and an inner pocket disposed in the rectangular portion and the second end, the inner pocket operable to seat a portion of the at least one component; and a pressure sleeve operable to receive the drill collar.

Statement 16: A pressure sleeve system is disclosed according to Statement 15, wherein the end pocket is shaped as a rounded triangle.

Statement 17: A pressure sleeve system is disclosed according to Statements 15 or 16, wherein the end pocket includes an end pocket surface that is planar and parallel to the base surface at a center of the rounded triangle and curves upwards to an end pocket edge.

Statement 18: A pressure sleeve system according to any of preceding statements 15-17, wherein the channel includes a first fillet between the channel and the transition surface and a second fillet between the channel and the end pocket, the first fillet and the second fillet each having a variable thickness and radius.

Statement 19: A pressure sleeve system according to any of preceding statements 15-18, wherein the channel surface curves upwards to each of the pair of protrusions.

Statement 20: A pressure sleeve system according to any of preceding statements 15-19, wherein the at least one component can include at least one of one or more electronic equipment, at least one sensor, at least one transmitter, at least one receiver, at least one battery, at least one power supply, at least one computing device, at least one computing device component, a sub-assemblies, and a sub-systems.

Statement 21: A drill collar having at least one pocket, the at least one pocket comprising: a rectangular portion extending from a first end to a second end, the rectangular portion having a base surface and opposing side surfaces, the opposing side surfaces being perpendicular to the base surface and parallel to each other, the opposing side surfaces extending to a rounded end at each of the first end and the second end; each of the first end and the second end having a transition surface extending from the base surface to a pair of shoulder surfaces, a pair of protrusions, and a channel, the pair of shoulder surfaces and a surface of the channel being parallel to the base surface, the channel extending to an end pocket in communication with an aperture; and an inner pocket disposed in the rectangular portion and the second end, the inner pocket operable to seat a portion of at least one component.

Statement 22: A drill collar is disclosed according to Statement 21, wherein an edge of the at least one pocket is elliptical at each of the first end and the second end.

Statement 23: A drill collar is disclosed according to Statements 21 or 22, wherein the at least one component can include at least one of one or more electronic equipment, at least one sensor, at least one transmitter, at least one receiver, at least one battery, at least one power supply, at least one computing device, at least one computing device component, a sub-assemblies, and a sub-systems.

The disclosures shown and described above are only examples. Even though numerous characteristics and advantages of the present technology have been set forth in the foregoing description, together with details of the structure and function of the present disclosure, the disclosure is illustrative only, and changes can be made in the detail, especially in matters of shape, size and arrangement of the parts within the principles of the present disclosure to the full extent indicated by the broad general meaning of the terms used in the attached claims. It will therefore be appreciated that the embodiments described above can be modified within the scope of the appended claims.

What is claimed is:

1. A pressure sleeve system comprising:

a drill collar having at least one pocket for receiving at least one component, the at least one pocket comprising:

a rectangular portion extending from a first end to a second end, the rectangular portion having a base surface, each of the first and the second end having a transition surface extending from the base surface to a pair of shoulder surfaces, a pair of protrusions, and a channel, the pair of shoulder surfaces and a surface of the channel being parallel to the base surface, the channel extending to an end pocket, at least one of the end pockets in communication with an aperture, wherein the channel includes a first fillet between the channel and the transition surface and a second fillet between the channel and the end pocket, the first fillet and the second fillet each having a variable thickness and radius; and a pressure sleeve operable to receive the drill collar.

2. The pressure sleeve system of claim 1, wherein the end pocket is shaped as a rounded triangle.

3. The pressure sleeve system of claim 2, wherein the end pocket includes an end pocket surface that is planar and parallel to the base surface at a center of the rounded triangle and curves upwards to an end pocket edge.

4. The pressure sleeve system of claim 3, wherein the end pocket edge is rounded.

5. The pressure sleeve system of claim 1, wherein the channel surface curves upwards to each of the pair of protrusions.

6. The pressure sleeve system of claim 1, wherein an edge of the at least one pocket is elliptical at each of the first end and the second end.

7. The pressure sleeve system of claim 1, wherein the at least one pocket includes four pockets.

8. The pressure sleeve system of claim 1, wherein the at least one pocket further comprises an inner pocket disposed in the rectangular portion and the second end, the inner pocket operable to seat a portion of the at least one component.

9. The pressure sleeve system of claim 8, wherein the inner pocket includes an inner pocket rectangular portion extending from a first inner pocket end to a second inner pocket end.

10. The pressure sleeve system of claim 9, wherein an inner pocket surface of the rectangular portion is cylindrical.

11. The pressure sleeve system of claim 10, wherein each of the first inner pocket end and the second inner pocket end include an inner pocket end surface, and wherein the inner pocket end surface is elliptical.

12. The pressure sleeve system of claim 11, wherein the second inner pocket end extends through the transition surface and to the channel of the second end.

13. A pressure sleeve system comprising:

a drill collar having at least one pocket for receiving at least one component, the at least one pocket comprising:

a rectangular portion extending from a first end to a second end, the rectangular portion having a base surface, and each of the first and the second end having a transition surface extending from the base surface to a pair of shoulder surfaces, a pair of protrusions, and a channel, the pair of shoulder surfaces and a surface of the channel being parallel to the base surface, the channel extending to an end pocket, at least one end pocket in communication with an aperture, wherein the channel includes a first fillet between the channel and the transition surface and a second fillet between the channel and the end pocket, the first fillet and the second fillet each having a variable thickness and radius, and an inner pocket disposed in the rectangular portion and the second end, the inner pocket operable to seat a portion of the at least one component; and a pressure sleeve operable to receive the drill collar.

14. The pressure sleeve system of claim 13, wherein the end pocket is shaped as a rounded triangle.

15. The pressure sleeve system of claim 14, wherein the end pocket includes an end pocket surface that is planar and parallel to the base surface at a center of the rounded triangle and curves upwards to an end pocket edge.

16. The pressure sleeve system of claim 13, wherein the channel surface curves upwards to each of the pair of protrusions.

17. A drill collar having at least one pocket, the at least one pocket comprising:

a rectangular portion extending from a first end to a second end, the rectangular portion having a base surface and opposing side surfaces, the opposing side surfaces being perpendicular to the base surface and parallel to each other, the opposing side surfaces extending to a rounded end at each of the first end and the second end;

each of the first end and the second end having a transition surface extending from the base surface to a pair of shoulder surfaces and a channel, the pair of shoulder surfaces and a surface of the channel being parallel to the base surface, the channel extending to an end pocket, at least one of the end pockets in communication with an aperture, wherein the channel includes a first fillet between the channel and the transition surface and a second fillet between the channel and the end pocket, the first fillet and the second fillet each having a variable thickness and radius; and an inner pocket disposed in the rectangular portion and the second end, the inner pocket operable to seat a portion of at least one component.

18. The drill collar of claim 17, wherein an edge of the at least one pocket is elliptical at each of the first end and the second end.

* * * * *